US006673172B2

(12) United States Patent
Wheatley et al.

(10) Patent No.: US 6,673,172 B2
(45) Date of Patent: Jan. 6, 2004

(54) GAS GENERANT COMPOSITIONS EXHIBITING LOW AUTOIGNITION TEMPERATURES AND METHODS OF GENERATING GASES THEREFROM

(75) Inventors: Brian K. Wheatley, Marshall, VA (US); Aaron J. Greso, Culpeper, VA (US); Norman H. Lundstrom, Fox Island, WA (US)

(73) Assignee: Atlantic Research Corporation, Gainesville, VA (US)

( * ) Notice: Subject to any disclaimer, the term of this patent is extended or adjusted under 35 U.S.C. 154(b) by 90 days.

(21) Appl. No.: 09/849,439

(22) Filed: May 7, 2001

(65) Prior Publication Data

US 2003/0015266 A1 Jan. 23, 2003

(51) Int. Cl.[7] ..... C06B 43/00
(52) U.S. Cl. ..... 149/36; 149/45
(58) Field of Search ..... 149/36, 45

(56) References Cited

U.S. PATENT DOCUMENTS

| | | | | |
|---|---|---|---|---|
| 3,954,528 A | | 5/1976 | Chang et al. | |
| 4,111,728 A | | 9/1978 | Ramnarace | |
| 4,336,085 A | | 6/1982 | Walker et al. | |
| 4,806,180 A | | 2/1989 | Goetz et al. | |
| 4,931,111 A | | 6/1990 | Poole et al. | |
| 4,948,439 A | | 8/1990 | Poole et al. | |
| 5,084,118 A | | 1/1992 | Poole | 149/22 |
| 5,411,615 A | | 5/1995 | Sumrail et al. | 149/47 |
| 5,460,671 A | | 10/1995 | Khandhadia | 149/109.6 |
| 5,531,941 A | * | 7/1996 | Poole | 264/3.4 |
| 5,739,460 A | | 4/1998 | Knowlton et al. | |
| 5,747,730 A | | 5/1998 | Scheffee et al. | |
| 5,763,821 A | | 6/1998 | Wheatley | 149/19.5 |
| 5,811,725 A | | 9/1998 | Klager | 149/19.4 |
| 5,850,053 A | | 12/1998 | Scheffee et al. | 149/19.91 |
| 5,883,330 A | | 3/1999 | Yoshida | 149/83 |
| 5,886,842 A | | 3/1999 | Ziperovich | 360/51 |
| 5,913,537 A | | 6/1999 | Goetz | |
| 6,017,404 A | | 1/2000 | Lundstrom et al. | 149/36 |
| 6,093,269 A | | 7/2000 | Lundstrom et al. | 149/36 |
| 6,143,101 A | | 11/2000 | Lundstrom | 149/36 |
| 6,435,552 B1 | * | 8/2002 | Lundstrom et al. | 280/741 |

* cited by examiner

*Primary Examiner*—John Hardee
(74) *Attorney, Agent, or Firm*—Nixon & Vanderhye P.C.

(57) ABSTRACT

Gas generant compositions exhibit low autoignition temperatures. In preferred forms, the gas generant compositions include azobisformamidine dinitrate (AZODN) and a eutectic mixture (comelt) of silver nitrate and potassium nitrate. The comelt of silver nitrate and potassium nitrate is most preferably present in the formulations of the invention in an amount to achieve a low autoignition temperature of between about 140° C. (284° F.) to about 160° C. (320° F.). The compositions of the invention may include a variety of auxiliary components typically employed in conventional gas generant compositions for their intended purpose. For example, especially preferred formulations of the present invention will include a powdered metal or metal oxide as a combustion catalyst to speed the decomposition reaction and also as a combustion aid to facilitate the ignition of the primary propellant or gas generant.

53 Claims, No Drawings

GAS GENERANT COMPOSITIONS EXHIBITING LOW AUTOIGNITION TEMPERATURES AND METHODS OF GENERATING GASES THEREFROM

FIELD OF THE INVENTION

The present invention relates generally to gas generant compositions, especially gas generant compositions employed in various autoignition devices, such as vehicle occupant passive restraint systems (air bags), fire suppressants, aircraft escape chutes, life rafts and the like.

BACKGROUND AND SUMMARY OF THE INVENTION

Auto-ignition and ignition materials are used in many gas generator devices such as protective passive restraints or air bags used in motor vehicles, escape slide chute, life rafts, fire suppressant canisters, and the like, the inflation devices of which are normally stored in a deflated state and are inflated with gas substantially instantaneously at the time of need. Such devices are often stored and used in close proximity to humans and, therefore, must be designed with a high safety factor that is effective under all conceivable operational conditions.

Inflation is sometimes accomplished solely by means of a gas generant composition and its' associated ignition devices. At other times, inflation is accomplished by means of a gas or mixture of gases, such as air, nitrogen, carbon dioxide, helium, and the like, which is stored under pressure, and further pressurized and supplemented at the time of use by the addition of high temperature combustion products produced by the combustion of gas generative compositions and their associated auto-ignition and ignition compositions. The use of a stored, pressurized gas in conjunction with a supplemental gas generative composition is often referred to a "hybrid system", since it is neither purely stored gas, nor solely reliant on a gas generative composition alone to accomplish inflation. Stored gas pressure in these hybrid inflators can sometimes reach 4,000 psi and greater. As will be discussed later, this condition is an important factor in the present invention. Note that the current invention will be especially useful in all hybrid inflators, whether the stored gas is inert (i.e, nitrogen, helium, argon, etc.) or whether the stored gas is oxygenated (i.e., contains some oxygen in addition to inert gases) to supplement fuel-rich exhaust products from the gas generator.

It is, of course, critical that the gas generative composition be capable of safe and reliable storage without decomposition or ignition at temperatures that are likely to be encountered in a motor vehicle or other storage environment. For example, temperatures as high as about 70 to 85° C. may be reasonably experienced under extreme operational conditions in the field. Further, quality assurance testing during the manufacturing and testing process often requires even higher temperature exposures in the range of 107 to 115° C. and greater. It is important that the gas generative device be thermally stable under these extreme environments where unexpected ignition could endanger people and facilities.

Ignition materials are commonly employed in these gas generative designs to safely ignite the gas generant when an electrical signal is received in response to an automobile impact or other stimulus. The ignition train, consisting of squib, initiator, booster material, auto-ignition device, and other secondary ignitors, must also be thermally stable at the extreme temperatures described above. In certain cases, the subject auto-ignition device may be part of the ignition squib device, separate from the other ignition components, part of the primary or secondary ignitor, or may make up the entire primary and/or secondary ignitor charge depending on the inflator design.

Generally, the air bag inflator, or other related devices, must exhibit benign response to environments wherein the decomposition temperature and gas generation of the primary gas generant, or a significant portion thereof, is reached. This condition would occur in the event that the device is exposed to a fire or high heat condition, such as might develop after an automobile crash or similar event.

Following slow or rapid heating to the decomposition temperature, most air bag inflation devices will decompose so rapidly that over-pressurization and explosion of the device is likely. To prevent this potentially life-threatening condition, inflation devices are often equipped with an auto-ignition material or propellant (hereafter referred to as "AIP"), designed to ignite at a temperature substantially lower than the decomposition temperature of the main gas generative composition. The AIP is usually present in small charges such that when the AIP ignites during a fire or other heating condition, a catastrophic explosion does not occur, but rather the AIP benignly burns and ignites one or more of the components in the ignition train or the main gas generant. The AIP is preferably located within the inflator in an area that is most conducive to thermal conductivity and/or to provide the desired performance characteristics.

As is noted below, where the gas generative composition is subject to melting prior to decomposition, it is desirable that the AIP device functions prior to reaching the melt temperature, as this avoids unpredictable and potentially catastrophic rapid burning and over-pressurization of the liquid components. As will be seen, this is a potential problem with certain gas generative compositions based on ammonium nitrate solid solution and eutectic mixtures.

A review of the art from the past decade shows an initial movement away from highly toxic azide-based gas generative compositions. New, low-cost, lower toxicity, more efficient clean burning replacements for the old azide-containing compositions were sought (see U.S. Pat. No. 6,017,404 to Lundstrom et al and U.S. Pat. No. 5,883,330 to Yoshida). Main gas generative formulations exhibiting higher melt temperatures offered an advantage when selecting an AIP formulation since theory suggests that the AIP must ignite prior to the melting point of the main gas generative composition in order to survive slow cook off. Thus, higher melting points would permit the formulator to select more easily tailored higher auto ignition temperature AIP mixtures. For the higher melting gas generative formulations developed under these goals, many AIP formulations have been tailored to meet higher temperatures in the range of 150 to 180° C. and higher (see U.S. Pat. No. 5,084,118 to Poole).

The search for clean, low-cost oxidizers led to the development of ammonium nitrate (AN)-based formulations. However, some of these formulations suffered from inadequate thermal-cycling stability due to the well-known problems associated with a phase change and volumetric shifts. This problem sometimes led to dimensional instability and grain cracking, which caused the ballistic properties of gas generative device to degrade. In an effort to resolve this problem, the use of certain blended oxidizer systems, wherein AN solid solution and eutectic mixtures were employed, were developed (see U.S. Pat. No. 5,850,053 to Scheffee et al and U.S. Pat. No. 5,411,615 to Sumrail et al).

One drawback to the eutectic mixtures and solid solutions with AN was the aforementioned low melting point characteristic. These formulations often exhibited melting points in the range of 120 to 130° C. This fact, along with the need for new, lighter weight pressure vessels made out of aluminum which suffered from severe strength losses at higher temperatures (see U.S. Pat. No. 5,084,118 to Poole), motivated the industry to search for new AIP mixtures that would provide ignition temperatures in the range of 130 to 170° C.

Initial attempts at development of new low temperature AIP to meet this criteria made use of (1) effective catalyst combined with AP/fuel mixtures (see U.S. Pat. No. 5,763,821 to Wheatley), (2) chlorate-based mixtures in combination with organic sugars and organic acids (see U.S. Pat. No. 5,460,671 to Khandhadia), and (3) low melting oxidizers to increase reactivity of the mixture at the melt zone (see U.S. Pat. No. 5,886,842 to Wilson et al). Recently, U.S. Pat. No. 5,739,460 to Knowlton et al disclosed the use of molybdenum fuels in combination with low melting oxidizers based on silver nitrate to achieve lower auto-ignition temperatures.

Clean, fast-burning, self-deflagrating fuels have also been proposed that could be used as a main constituent of the gas generative composition, or, if the auto-ignition temperature were low enough, that could be used in a new family of AIP compositions (see U.S. Pat. No. 5,811,725 to Klager, U.S. Pat. No. 6,093,269 to Lundstrom et al, and U.S. Pat. No. 6,143,101 to Lundstrom). Compounds containing azo-functional groups were identified as potentially fast burning fuels. U.S. Pat. No. 6,093,269 to Lundstrom et al identified a new type of azo-functional compound for gas generant devices. This compound, azobisformamidine dinitrate, also known as azodiformamidine dinitrate, or azodicarbonamidine dinitrate (all three hereafter=AZODN) as described in the Lundstrom et al '269 patent, proved to be a clean, fast-burning compound with a high oxygen content. It also exhibited an inherently low decomposition point in the range of 170 to 180° C. depending on test method, yet was thermally stable over the severe temperature conditions of the automotive airbag specifications. As described in U.S. Pat. No. 6,143,101 to Lundstrom, this compound provided the basis for a new family of AIP compositions having an auto-ignition temperature in the range of 150 to 170° C.

However, use of the low-cost, AN-based eutectics and solid-solutions for gas generative compositions in the hybrid devices wherein the stored gas pressures are nominally between 3,000 and 4,000 psi at ambient temperatures, created the need for a new, more aggressive AIP composition. In these hybrid systems, the pressure effect on the AIP resulted in decreased thermal stability such that AIP compositions that were formerly stable at ambient pressures, now failed to meet the thermal soak criteria under pressure. In many AIP compositions, the gap between the auto-ignition temperature and the maximum temperature to meet thermal soak widened. Although not thoroughly understood, it is believed that the gas pressure may confine or imprison volatile, auto-catalytic-decomposition products that would otherwise escape, thus reducing the stability of the AIP to long exposure to high temperature. A similar effect has been noted where compositions are thermally stable when vented to the atmosphere, but are thermally unstable in the same environment when hermetically sealed. This effect has been especially pronounced in certain formulations containing ceric ammonium nitrate.

Due to these and other factors, none of the AIP compositions generally noted above were able to meet the severe conditions imposed by the hybrid environment, while still meeting the auto-ignition needs of the gas generative device to fire or other high temperature conditions. The AZODN-based mixtures for use with AN-based eutectics and solid solutions did not offer a low enough auto-ignition temperature. The molybdenum-based mixtures were not thermally stable under pressure at standard inflator test conditions (i.e., 107 to 115° C.), and could not be safely compacted into a pellet form without suffering decomposition during long-term thermal storage conditions. The chlorate- and AP-based mixtures proved to be especially susceptible to the pressure effect, causing large shifts in thermal soak and auto-ignition temperatures. Chlorate-based mixtures were generally not desirable anyway due to concern for the formation of ammonium chlorate when used with AN-based systems, and their sensitivity to contamination by certain organic salts and acids.

Thus, the current art does not satisfy the needs of the new hybrid and dual hybrid ("smart" airbags) gas generator designs, where these designs incorporated the low-melting AN-based eutectics and solid solutions. These designs needed a new AIP that was thermally stable under pressure at temperatures up to the range of 115 to 130° C., and yet would ignite rapidly at temperatures between 130 and 150° C. None of the above approaches offered this sharp temperature transition between thermally stable and auto-ignition conditions when under pressurized conditions, where the auto-ignition temperature was in the range of 130 to 150° C.

Broadly, the present invention is related to gas generant compositions which exhibit low autoignition temperatures. In preferred forms, the present invention is embodied in gas generant compositions which are comprised of azobisformamidine dinitrate (AZODN) and a low-melting oxidizer which includes a eutectic or solid solution of two or more nitrate or perchlorate salts. A low-melting oxidizer comprised of silver nitrate and potassium nitrate is preferred in the formulations of the invention in an amount to achieve a low autoignition temperature of between about 116° C. (241° F.) to about 150° C. (302° F.).

The compositions of the invention may include a variety of auxiliary components typically employed in conventional gas generant compositions for their intended purpose. For example, especially preferred formulations of the present invention will include a powdered metal or metal oxide as a combustion catalyst to speed the decomposition reaction and also as a combustion aid to facilitate the ignition of the primary propellant or gas generant.

The current invention is directed to meet these goals and provide a substantially azide-free and chlorate-free auto-ignition composition. Specifically, the invention is especially embodied in an azide- and chlorate-free composition that is comprised of (i) the low auto-ignition fuel, AZODN, (ii) a low melting oxidizer mixture comprised of binary, tertiary, or ternary eutectic or solid solution mixtures of nitrate and/or perchlorate salts, (iii) a low melting organic fuel that lowers the auto-ignition temperature and also provides acid scavenging (thermal stabilizer) effect as in n-MNA, and (iv) a catalytic metal oxide powder. In this invention, one function of the acid scavenger is to react with and render neutral various auto catalytic species which, if left in the composition, will promote more rapid decomposition and reduce the useful shelf-life of the AIP mixture. One especially preferred AIP composition in accordance with the current invention includes AZODN, the binary solid solution of silver nitrate and potassium nitrate, n-MNA, and super-fine iron oxide (NANOCAT). These and other aspects and advantages will become more apparent after careful consideration is given to the following detailed description of the preferred exemplary embodiments thereof.

These and other aspects and advantages will become more apparent after careful consideration is given to the following detailed description of the preferred exemplary embodiments thereof.

DETAILED DESCRIPTION OF THE INVENTION

The compositions of the present invention will necessarily include a novel, self-deflagrating fuel, AZODN and an oxidizer system made from blended nitrate and/or perchlorate salts, where the blend is comprised of two or more salts prepared in an aqueous or hot-melt process to yield a solid solution or eutectic mixture. In a preferred form, the above oxidizer will exhibit a melting or softening point in the range of 120 to 150 C. and will be thermally stable with AZODN at temperatures in excess of 115° C. Further, the mixture will be thermally stable at temperatures greater than 115° C. under ambient pressure and also when pressurized with inert or oxygenated gas. In this invention, the phrase "thermally stable" refers to the ability of the AIP charge to withstand at least 6 hours at temperature in either the pressurized or non-pressurized condition. A variety of oxidizers, catalysts, fuels, ballistic modifiers, binders and process aids may be incorporated into the compositions of the present invention.

The AZODN fuel may be prepared by treating a nitric acid solution of an amino guanidine salt (e.g., nitrate, carbonate, etc.) with an aqueous permanganate solution.

The preferred composition will use an oxidizer system comprised of silver nitrate and potassium nitrate at roughly molar equivalence where the weight of silver nitrate will range between 60 to 75 percent of the total oxidizer weight. One comelt that may be employed in the present invention is disclosed in detail in U.S. Pat. No. 5,739,460 to Knowlton et al (the entire content of which is expressly incorporated hereinto by reference). Although the eutectic point is often advantageous to obtain the lowest melting point possible for a given mixture, other blend ratios may be used to influence melt temperature and influence the onset of the auto-ignition event.

One or more thermal stabilizers, that also function as a low melting fuel, benefit the present invention, not only to improve thermal stability of the mixture at high temperature storage, but also to shift the auto-ignition temperature of the mixture to a lower value. These stabilizers are typically weak organic bases, such as substituted diphenyl-amines and substituted nitro-anilines, that improve stability by scavenging acids and other species that contribute to the decomposition of the AIP. In the present invention, N-methyl-4-nitroaniline, for instance, melts at about 153 C. and 2-methyl-4-nitroaniline melts at about 132 C. Similarly, 4-nitro-diphenylamine melts at about 133 C. Contents of up to 10 percent of these compounds have been used to effectively lower the auto-ignition temperature of the mixture while simultaneously increasing the stability at 107 C. storage.

One or more auxiliary, high-oxygen content fuels may also optionally be included in the compositions of the present invention to increase flame temperature, alter burning rate, or change the gas yield. In this regard, guanidine nitrate (GN), aminoguanidine nitrate (AGN), diamino guanidine nitrate (DAGN), triamino guanidine nitrate (TAGN), aminoguanidine dinitrate (AGDN), cyanoguanidine nitrate (CGN), 5-aminotetrazole nitrate (5-ATN), nitroguanidine (NQ), cyclotrimethylenetrinitramine (RDX), cyclotetramethylenetetranitramine (HMX), ethylene diamine dinitrate (EDDN), or other energetic fuel may be employed in the compositions of the present invention, but are not essential to its performance. These may be added as diluents to off-set the cost of more expensive ingredients and/or further tailoring of the autoignition temperature of the final composition. The auxiliary fuel may be present in the compositions of the present invention in amounts up to about 35 wt. %. Typically, the auxiliary fuel will be present, if employed in the compositions of the present invention, in amounts between about 20 wt. % to about 25 wt. %.

Preferred compositions will include a powdered metal or metal oxide as a combustion catalyst to speed the decomposition reaction and also as a combustion aid to facilitate the ignition of the primary propellant or gas generant. The metal or metal oxide powder that may be used in the compositions of the present invention includes those based on iron, aluminum, copper, boron, magnesium, manganese, silica, titanium, cobalt, zirconium, hafnium, and tungsten. Other metals such as chromium, vanadium, and nickel may be used in limited capacity since they pose certain toxicity and environmental issues for applications such as automotive airbags. Examples of the corresponding metal oxides include for example: Oxides of iron (i.e., $Fe_2O_3$, $Fe_3O_4$); Aluminum oxide (i.e., $Al_2O_3$); Magnesium oxide (MgO); Titanium oxide ($TiO_2$); copper oxide (CuO); boron oxide ($B_2O_3$); silica oxide ($SiO_2$); and various manganese oxides, such as MnO, $MnO_2$ and the like. As is commonly presented in the literature, the finely dispersed or fumed form of these catalysts and ballistic modifiers are often the most effective. These metal or metal oxide powders may be used singly, or in admixture with one or more other such powder. One particularly preferred powder for use in the compositions of the present invention is superfine iron oxide powder commercially available from Mach I Corporation of King of Prussia, Pa. as NANOCAT® superfine iron oxide material. This preferred iron oxide powder has an average particle size of about 3 nm, a specific surface density of about 250 $m^2g$, and bulk density of about 0.05 gm/ml. The metal or metal oxide powder, if present, will be employed in the compositions of the present invention in an amount between about 0.25 to about 10.0 wt. %, and more preferably about 1.0 wt. %.

The compositions of this invention may also include an ignition accelerator/augmentor/enhancer in the form of a graphite powder. The preferred graphite powder has an average particle size of about 40 microns. One particularly preferred graphite powder is Microfyne™ Graphite commercially available from Joseph Dixon Crucible Company of Jersey City, N.J. When used, the graphite accelerator/augmentor is present in the compositions of this invention in an amount between about 0.1 wt. % to about 2.0 wt. %, and more preferably between about 0.5 wt. % to about 1.5 wt. %.

The compositions of the present invention may also include conventional processing aids and coatings as may be desired for particular end-use applications and/or properties such as, graphite, various stearate, silicone oils, such as polydimethylsiloxane (PDMS), fumed silicas, fumed aluminas, talc, mica and clays.

An especially preferred composition of the present invention contain about 61 wt. % AZODN, about 33 wt. % silver nitrate/potassium nitrate solid solution, about 5 wt. % n-methyl paranitroaniline (n-MNA), and about 1 wt. % percent NANOCAT iron oxide, wherein the solid solution is comprised of approximately 23.5 wt. % silver nitrate and 9.5 wt. % potassium nitrate.

The compositions may be used in the form of powders, granules, grains or compression-molded pellets. When used in the form of a solid compression-molded mixture of the above-noted components, the compositions will therefore most preferably include a polymeric binder in an amount sufficient to help bind the components into a solid form (e.g., pellet). The binder will therefore typically be present in an amount, based on the total composition weight, of between about 1.0 to about 6.0 wt. %, and preferably between about 2.0 to about 4.0 wt. %. Examples of binders include cellulose acetate (CA), polyvinyl acetate (PVAC), cellulose acetate butyrate (CAB), poly(alkylene carbonates), and methyl cellulose (MC). The preferred binders are those poly(alkylene carbonates) commercially available from Pac Polymers, Inc. as Q-PAC® 40, a poly(propylene carbonate) copolymer, and Q-PAC® 25, a poly(ethylene carbonate) copolymer, or mixtures thereof. In the form of the invention where the mixture will be used as a loose powder fill, a binder is not used.

Processing of the preferred formulation is accomplished by preparing the solid solution oxidizer in advance using aqueous or hot-melt processes. The oxidizer product is then granulated at room temperature by mechanical grinding equipment and dry blended with the rest of the dry ingredients in a 3-dimensional shaker/mixer to achieve a uniform blend. In the formulation approach utilizing a binder, the binder is added in a finely granulated form as one of the dry ingredients, or the binder is dispersed in a suitable solvent (e.g., methylene chloride), along with any wetting agents, coatings, or processing aids, and blended onto the AZODN fraction of the mix. The solvent is removed under vacuum and heat to yield coating on the AZODN particles. The resultant mix is then blended with the other dry ingredients in the usual manner.

A particularly preferred formulation in accordance with the present invention include the following:

| Component: | Amount (wt. %): |
|---|---|
| AZODN | 40–65 |
| $AgNO_3$—KN comelt | 30–35 |
| iron oxide | 0.5–5 |
| n-MNA | 2–5 |

The composition noted above may include one or more of the following optional ingredients:

| Optional Ingredient: | Amount (wt. %): |
|---|---|
| Graphite | up to 2.0 |
| Binder | up to 10 |
| Auxiliary Fuel | up to 25 |
| Other Ingredients (e.g., coatings, processing aides, wetting agents, and the like) | up to 15 |

The invention may be used in the form of loose powder fill, compacted/densified granules, or pressed pellets that are loaded into crimped metal cartridges at nominal loading levels between 50 and 250 mg. When the formulations are processed as compacted granules, they are most preferably formed by pressing and then grinding the pellets to a fixed particle distribution, such as −40/+100 mesh. Such compacted granules have been found to autoignite approximately 5° C. to 8° C. lower than the auto-ignition temperatures of either the pressed pellet of the base powder mix containing the same ingredients.

The present invention will be further described with reference to the following non-limiting Examples.

EXAMPLES

The thermal stability characteristics and auto-ignition properties were initially investigated at atmospheric pressures. Subsequent studies revealed that these mixtures, when subjected to pressure in the form of inert gases such as argon or argon/helium mixtures used in hybrid airbag inflators, exhibited different behavior with respect to thermal stability and auto-ignition. For this reason, the data in the following Examples have been subdivided into separate sections for ease of discussion and clarity of presentation.

A. Ambient Pressure Results

As will be observed from the data appearing below, some formulations had less thermal stability than others after 17 days at 107° C. Certain stabilizers commonly employed in nitrate ester propellants to scavenge nitrogen oxides, such as n-methylparanitroaniline (n-MNA) may thus be employed in such formulations so as to improve shelf life without adversely affecting the formulation autoignition temperature. In this regard, the thermal stabilizer will be used in amounts sufficient to achieve thermal stability after 17 days and 107° C. In this regard, if needed, such thermal stabilizers will be employed in an amount between about 1 wt. % to about 10 wt. %, and more preferably between about 2 to about 5 wt. %. Specifically, n-MNA when employed in amounts between about 2 wt. % to about 5 wt. % has been found to improve shelf-life stability at 107° C. and also produced a decreased autoignition temperature by approximately 5 to 8° C. as compared to the formulation not having the n-MNA thermal stabilizer.

Example 1

Powdered formulations F1 through F5 as listed in Table 1 below were prepared. The formulations were tested for auto-ignition temperatures using a copper-block auto-ignition test and were visually assessed for relative reaction intensity and thermal stability (after 17 days at 107° C.). The results also appear in Table 1 below.

TABLE 1

| | Formulation No. | | | | |
|---|---|---|---|---|---|
| | F1 | F2 | F3 | F4 | F5 |
| Composition (wt. %): | | | | | |
| AZODN | 65 | 45 | 64 | 45 | 44 |
| $AgNO_3$—KN comelt* | 35 | 35 | 35 | 35 | 35 |
| iron oxide | | | 1 | | 1 |
| GN | | 20 | | | |
| NQ | | | | 20 | 20 |
| Auto-Ignition Temp. (° C.) | 155 | 155 | 150 | 154 | 146 |
| Reaction Intensity | weak, smoke only, no flame | vigorous flame | vigorous flame | vigorous flame | vigorous flame |
| Thermal Stability 17 days/107° C. | Moderate increase in auto-ignition temperature | Moderate increase in auto-ignition temperature | Moderate increase in auto-ignition temperature | unstable | unstable |

*silver nitrate-potassium nitrate comelt at 2.5:1 weight ratio.

The formulation F3 noted above in Table 1 was also evaluated as a compacted pellet and found to autoignite at about the same temperature as the dry powder mixture. Autoignition tests after 17 days at 107° C. showed that the mixture was thermally stable (i.e., moderate increase in auto-ignition temperature of about 5 to 10° C.).

Example 2 (Comparative)

Since the formulations 4 and 5 containing nitroguanidine in combination with the comelt and iron oxide were found to be thermal unstable, where the reaction weakens and the autoignition temperature increases with increasing aging at 107° C., additional formulations were made and tested to determine the effect of the various components, using Formulation 3 in Table 1 above as the "baseline" formulation. These comparative formulations are noted below in Table 2 as Comparative Formulations (CF) 1 through 3, respectively. For ease of comparison, the data noted above in Table 1 for formulation 3 has been repeated below in Table 2.

TABLE 2

| | Formulations | | | |
|---|---|---|---|---|
| | F3 | CF1 | CF2 | CF3 |
| Composition (wt. %): | | | | |
| AZODN | 64 | 99 | 64 | 64 |
| $AgNO_3$-KN comelt* | 35 | | | |
| iron oxide | 1 | 1 | 1 | 1 |
| $AgNO_3$ | | | 35 | |
| KN | | | | 35 |
| Auto-Ignition Temp. (° C.) | 150 | 165 | 155 | 166 |
| Reaction Intensity | vigorous flame | weak | vigorous flame | weak |

*silver nitrate-potassium nitrate comelt at 2.5:1 weight ratio.

The data in Table 2 show that, with the exception of potassium nitrate (KN) alone (i.e., formulation CF3), the presence of AZODN and a comelt of silver nitrate and potassium nitrate in the presence of iron oxide, are needed in order to obtain a vigorous flame and low autoignition temperatures.

Example 3

Using formulation F3 in Table 1 again as a baseline, additional components were evaluated to determine their respective efficacy in terms of autoignition temperature and reaction energy. The data appear in Table 3 below. For ease of reference the data noted above in Table 1 for the baseline formulation F3 has been repeated below in Table 3.

TABLE 3

| | Formulation No. | | | | |
|---|---|---|---|---|---|
| | F3 | F6 | F7 | F8 | F9 |
| Composition (wt. %): | | | | | |
| AZODN | 65 | 40 | 40 | 65 | 65 |
| $AgNO_3$—KN comelt* | 35 | 35 | 35 | 35 | 35 |
| iron oxide | 1 | 1 | 1 | 1 | 1 |
| GN | | 25 | | | |
| RDX | | | 25 | | |
| Graphite | | | | | 1 |
| QPAC-40 | | | | 2 | 2 |
| Auto-Ignition Temp. (° C.) | 150 | 155 | 151 | 152 | 153 |
| Reaction Intensity | vigorous flame | vigorous flame | vigorous flame | vigorous flame | vigorous flame |

*silver nitrate-potassium nitrate comelt at 2.5:1 weight ratio.

The data above in Table 3 show that a number of additives can be incorporated into a preferred composition of the present invention without adversely affecting the temperature and vigor of the ignition reaction. In this regard, the presence of GN or RDX reduces the amounts of the expensive AZODN needed and does not affect the vigorous reaction. The addition of binders (i.e., 2 wt. % QPAC-40) polycarbonate) and process aids (i.e., 1 wt. % graphite) are shown to improve the producibility of the compositions without adversely affecting ignition properties.

Example 4

Using formulation F3 in Table 1 again as a baseline, the use of n-MNA was evaluated as a means of stabilizing the mixture with regard to auto-ignition temperature as a function of storage at 107 C. The data are presented in Table 4 below

TABLE 4

| | Formulation No. | | |
|---|---|---|---|
| | F3 | F10 | F11 |
| Composition (wt. %): | | | |
| AZODN | 65 | 62 | 61 |
| $AgNO_3$—KN comelt* | 35 | 34 | 33 |
| Iron oxide | 1 | 1 | 1 |
| n-MNA | | 3 | 5 |
| Initial auto-ignition temperature, (° C.) | 150 (to 156)** | 147 | 148 |
| Auto-ignition temperature after 17 days at 107° C., (° C.) | 161 | 152 | 143 |

*silver nitrate-potassium nitrate comelt at 2.5:1 weight ratio.
**a second mix exhibited an auto-ignition temperature of 156° C.

The data above in Table 4 show that n-MNA produced the desired effect, wherein the auto-ignition temperature did not increase as much, or was found to decrease slightly after the requisite 17-day aging interval at 107 C. The baseline auto-ignition temperature was found to drop with the addition of n-MNA. This is believed to be linked to the relatively low melting point of this compound (i.e., about 150 to 152 C.). Other similar compounds (i.e., certain of the nitrodiphenylamine family) with even lower melting points were investigated, and produced even lower auto-ignition values. However, these mixtures were not thermally stable at 107 C.

B. Pressurized Results

Table 5 below details the results of a series of oven stability, slow cook-off, and fast cook-off testing performed for generic types of AIP formulations. The data are used to compare thermal stability with auto-ignition performance for the various AIP formulations investigated.

The auto-ignition temperature of each formulation is given in Table 5 below in a pressurized bottle which is filled with inert argon gas to a pressure of about 3500 psi. prior to heating. During initial heating, the bottle pressure increases proportionally with the equilibrium temperature. Each test was performed at an isothermal temperature where the sample was held for a minimum of 6 hours. A sample consisted of at least 10 test AIP articles per 6 hour test. After the 6 hour hold at temperature and pressure, the pressurized bomb with its 10 test articles was vented and the sample inspected visually for signs of ignition or decomposition. If one or more of the articles has ignited, the result was recorded as a positive event. If none of the test articles ignited, the 10 articles were discarded, and a new group of 10 were then tested at an incrementally higher temperature until the go/no-go temperature threshold was determined. The temperature increments were iterated in steps of 2 to 5° C.

The heating rate of the inflators during the slow or fast cook-off testing is also provided in Table 5 below. The heating rate tests were performed in sets of three, and the values reported are the average of three tests. Heating rates of 14° C./min are considered to be fast cook rates, while heating rates of 5° C./min are considered to be slow cook-off rates. As noted, the rate of heating affects the temperature at which AIP ignites the inflator.

The skin temperature of the inflator pressure vessel is reported in Table 5 as of the time of ignition. Since the heating is derived from external ovens, the skin temperature will always be greater than the actual temperature of the AIP at the time of the auto-ignition event. Since the heating rate is constant, the bias between the skin temperature and AIP temperature is also essentially constant. Thus, the skin temperature is a good relative measure of cook-off temperature for comparison to auto-ignition temperature in the above mentioned oven stability test. The temperature difference (ΔT) between the two tests is also reported. Since one objective of the present invention was to maximize the thermal stability above 115° C. and minimize the cook-off temperature, the ΔT is an important measure of acceptable performance.

The physical result of the slow and fast cook-off tests is noted as a pass or a fail. The cook-off tests were conducted in sets of three inflators at each heating rate. A failure of any one of the three inflators was considered to be a failure for that heating rate. Failure is defined as rupturing of the wall of the pressure vessel, especially in the event that metal pieces are ejected.

Several families of auto-ignition materials were tested and compared to the current invention. These included the following comparative formulations and a formulation in accordance with the present invention:

CF1—Chlorate-based with lactose and 0.5 wt. % metal oxide catalyst

CF2—Chlorate-based with lactose and 1 wt. % metal oxide catalyst

CF3—Molybdenum based with guanidine nitrate and silver nitrate/potassium nitrate co-melt CF4—Molybdenum based (same as CF3 above, but without silver nitrite/potassium nitrate co-melt)

Invention (IF1): AZODN with silver nitrate/potassium nitrate solid solution/n-MNA/metal oxide catalyst

TABLE 5

| Auto-Ignition Formulation | Ignition Temp. (pressurized bottle)[1] | Oven Stability @ 115° C. | SCO Heating Rate, C/min | Skin Temp. @ Ignition, (° C.) | ΔT (° C.) | SCO Result (pass or fail)[2] |
|---|---|---|---|---|---|---|
| CF1 | 125 | Fail | 14 | 200 | 75 | Fail |
| | 125 | Fail | 5 | 190 | 65 | Fail |
| CF2 | 118 | Fail | 14 | 187 | 69 | Fail |
| | 118 | Fail | 5 | 207 | 89 | Fail |
| CF3 | 110 | Fail | 14 | 162 | 52 | Pass |
| | 110 | Fail | 5 | 143 | 33 | Pass |
| CF4 | 125 | Fail | 14 | 175 | 50 | Pass |
| | 125 | Fail | 5 | 170 | 45 | Fail |
| IF1 | 132 | Pass | 14 | 162 | 30 | Pass |
| | 132 | Pass | 5 | 145 | 13 | Pass |

[1]average maximum threshold temperature below which the mixture does not auto-ignite when held isothermally for 6 hours in a pressurized bottle at about 3500 psi

[2]pass refers to benign burn of the inflator without rupturing the pressure vessel or ejection of shrapnel from the test stand. Failure of any one of three orientations (up/down/sideways) is reported as a SCO failure.

As shown in Table 5, the auto-ignition temperature in the pressurized bottle test gave auto-ignition results ranging from 110° C. to 132° C., with the formulation in accordance with the present invention giving the highest ignition temperature, indicating the highest thermal stability. In the opposing slow cook-off test, the values ranged from skin temperatures of 143 to 207° C., with the current invention and the molybdenum based mixture offering the lowest cook-off temperatures. When comparing cook-off temperature and threshold thermal stability values, the delta values for the chlorates was the highest, ranging from 65 to 89° C. The formulation of the present invention offered the lowest values of 13° C. (slow cook off) and 30° C. (fast cook off). These results show that the formulation of the present invention offers a much sharper transition from the thermally stable condition to the cook-off condition where auto-ignition takes place. The formulation of the present invention and the CF3 formulation were the only two formulations of those tested that achieved a "pass" rating on both the slow and fast cook-off tests in a benign fashion. However, the CF3 formulation was not able to meet the thermal stability criteria of passing 6 hours at 115° C. or greater.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An auto-ignition material for a hot gas-producing device which exhibits a reduced auto-ignition temperature comprising azodiformamidine dinitrate (AZODN), and a low-melting oxidizer which consists essentially of a eutectic or solid solution of binary, tertiary or ternary mixtures of inorganic nitrates and/or perchlorate salts and a low-melting, acid scavenging thermal stabilizer and catalytic metal oxide.

2. The auto-ignition material of claim 1, wherein the thermal stabilizer includes a nitroaniline compound.

3. The auto-ignition material of claim 2, wherein the nitroaniline compound is n-methyl para-nitro aniline.

4. The auto-ignition material of claim 1, where the metal oxide is iron oxide.

5. The auto-ignition material of claim 1, comprising AZODN in an amount between about 25 to about 95 wt. %.

6. The auto-ignition material of claim 1, wherein the mixture contains a binder.

7. The auto-ignition material of claim 6, wherein the binder is at least one selected from the group consisting of cellulose acetate butyrate, methyl cellulose, polyethylene oxide carbonate, and polypropylene oxide carbonate.

8. The auto-ignition material of claim 1, in the form of a loose, granular powder.

9. The auto-ignition material of claim 1, in the form of a pressed pellet.

10. An auto-ignition material for a hot gas-producing device which exhibits a reduced auto-ignition temperature comprising azodiformamidine dinitrate (AZODN), and a low-melting oxidizer which consists essentially of a eutectic or solid solution of binary, tertiary or ternary mixtures of inorganic nitrates and/or perchlorate salts, wherein the oxidizer is a low-melting eutectic of solid solution comprised of silver nitrate and at least one other nitrate salt of a Group IA or Group IIA element.

11. The auto-ignition material of claim 10, wherein the oxidizer is a low-melting eutectic or solid solution comprised of silver nitrate and potassium nitrate.

12. The auto-ignition material of claim 11, wherein the low-melting eutectic or solid solution is comprised of about 25wt. % silver nitrate and about 10 wt. % potassum nitrate.

13. An auto-ignition material for a hot gas-producing device which exhibits a reduced auto-ignition temperature comprising azodiformamidine dinitrate (AZODN), and a low-melting oxidizer which consists essentially of a eutectic or solid solution of binary, tertiary or ternary mixtures of inorganic nitrates and/or perchlorate salts and further comprising AZODN in an amount of about 61 wt. %.

14. The auto-ignition material as in claim 1, 5 or 13, comprising said oxidizer in an amount between about 15 to about 55 wt. %.

15. The auto-ignition material of claim 14, comprising said oxdizer in an amount of about 33 wt. %.

16. The auto-ignition material of claim 15, comprising a stabilizer in an amount between about 0.5 to about 10 wt. %.

17. The auto-ignition material of claim 16, comprising the stabilizer in an amount of about 5 wt. %.

18. The auto-ignition material of claim 15, comprising a catalytic metal oxide in an amount between about 0.1 to about 10 wt. %.

19. The auto-ignition material of claim 18, comprising the catalytic metal oxide in an amount of about 1 wt. %.

20. A solid gas generant composition comprising azobisformamidine dinitrate (AZODN), and an oxidizer which includes a comelt of silver nitrate and potassium nitrate.

21. The composition of claim 20, wherein said AZODN is present in said composition in an amount between about 35 wt. % to about 75 wt. %.

22. The composition of claim 21, wherein said AZODN is present in an amount between about 40 wt. % to about 65 wt. %.

23. The composition of claim 20, wherein said comelt of silver nitrate and potassium nitrate is present in said composition in an amount effective to achieve an autoignition temperature of between about 140° C. to about 160°.

24. The composition of claim 23, wherein said comelt of silver nitrate and potassium nitrate is present in an amount between about 20 wt. % to about 45 wt. %.

25. The composition of claim 24, wherein said comelt of silver nitrate and potassium nitrate is present in an amount of about 35 wt. %.

26. The composition of claim 20, which further comprises a metal or metal oxide powder.

27. The composition of claim 26, wherein the metal or metal oxide powder is at least one selected from the group consisting of iron oxide, copper oxide, magnesium, aluminum, tungsten, titanium, zirconium and hafnium.

28. The composition of claim 27, wherein metal or metal oxide powder is present in an amount between about 0.25 wt. % to about 2.5 wt. %.

29. The composition of claim 26, which further comprises an auxiliary fuel which is at least one selected from the group consisting of guanidine nitrate (GN), aminoguanidine nitrate (AGN), nitroguanidine (NQ), ethylenediamine dinitrate (EDN), cyclotrimethylenetrin itramine (RDX) and/or cyclotetramethylenetetranitramine (HMX).

30. The composition of claim 29, wherein said auxiliary fuel is present in an amount of up to about 35 wt. %.

31. The composition as in claim 30, which further comprises an ignition accelerator which includes graphite powder.

32. The composition as in claim 31, wherein the ignition accelerator is present in an amount between about 0.1 wt. % to about 2.0 wt. %.

33. A solid powdered gas generant composition which consists essentially of (i) between about 40 to about 65 wt. % of azobisformamidine dinitrate (AZODN), (ii) between about 30 to about 35 wt. % of a eutectic mixture of silver nitrate and potassium nitrate, and (ii) between about 0.5 to about 1.5 wt. % of iron oxide.

34. The composition of claim 33, further comprising about 25 wt. % of guanidine nitrate (GN) or cyclotrimethylenetrinitramine (RDX).

35. The composition of claim 33, further comprising about 1 wt. % graphite.

36. A pellet which comprises a compressed solid powdered gas generant composition as in any one of claims 33–35.

37. The pellet of claim 36, which further comprises a binder.

38. The pellet of claim 37, wherein the binder comprises at least one selected from the group consisting of polyvinyl acetate (PVAC), cellulose acetate butyrate (CAB), and poly (alkylene carbonates).

39. The pellet of claim 38, wherein the binder is present in an amount between about 1.0 wt. % to about 6.0 wt. %.

40. A method of generating a gas which comprises combusting a solid gas generant composition as in claim 1 or 33.

41. An inflatable device which comprises a gas generant composition as in claim 1 or 33.

42. A method of inflating an inflatable device which comprises combusting an amount of a gas generant composition according to claim 1 or 33 to generate a sufficient amount of combustion gases to inflate the device.

43. A method of reducing the auto-ignition temperature of an autoignition material which comprises mixing, in amounts effective to reduce the auto-ignition temperature, azodiformamidine dinitrate (AZODN) and a low-melting oxidizer which consists essentially of a eutectic or solid solution of binary, tertiary or ternary mixtures of inorganic nitrates and/or perchiorate salts and low-melting, acid scavenging thermal stabilizer and catalytic metal oxide.

44. A method of reducing the auto-ignition temperature of an autoignition material which comprises mixing, in amounts effective to reduce the auto-ignition temperature, azodiformamidine dinitrate (AZODN), and an oxidizer which includes a comelt of silver nitrate and potassium nitrate.

45. The method of claim 44, wherein said comelt of silver nitrate and potassium nitrate is present in an amount effective to achieve an autoignition temperature of between about 140° to about 160°.

46. The method of claim 43 or 44, which comprises mixing AZODN in an amount between about 25 to about 95 wt. %.

47. The method of claim 46, comprising mixing AZODN in an amount of about 61 wt. %.

48. The method of claim 43 or 44, comprising mixing the oxidizer in an amount between about 15 to about 55 wt. %.

49. The method of claim 48, comprising mixing the oxidizer in an amount of about 33 wt. %.

50. The method of claim 43 or 44, further comprising mixing a stabilizer in an amount between about 0.5 to about 10 wt. %.

51. The method of claim 50, comprising mixing the stabilizer in an amount of about 5 wt. %.

52. The method of claim 43 or 44, further comprising mixing a catalytic metal oxide in an amount between about 0.1 to about 10 wt. %.

53. The method of claim 52, comprising mixing the catalytic metal oxide in an amount of about 1 wt. %.

* * * * *